US005641120A

United States Patent [19]

Kuykendal et al.

[11] Patent Number: 5,641,120

[45] Date of Patent: Jun. 24, 1997

[54] FLUID FLOW NOZZLE ASSEMBLY AND METHOD

[76] Inventors: Robert L. Kuykendal; Ronald S. Deichmann, both of 1136 Washington St., St. Louis, Mo. 63101

[21] Appl. No.: 488,968

[22] Filed: Jun. 8, 1995

[51] Int. Cl.[6] ..... F21P 7/00

[52] U.S. Cl. ..... 239/18; 239/590.5; 239/470

[58] Field of Search ..... 239/18, 468, 470, 239/590.5, 553.5

[56] References Cited

U.S. PATENT DOCUMENTS

| | | | |
|---|---|---|---|
| 530,620 | 12/1894 | Maher | 239/470 |
| 2,737,414 | 3/1956 | Wenzel | 239/470 X |
| 4,884,751 | 12/1989 | Peffit | 239/468 |

FOREIGN PATENT DOCUMENTS

| | | | |
|---|---|---|---|
| 1321507 | 2/1962 | France | 239/468 |
| 298257 | 10/1992 | Japan | 239/590.5 |

*Primary Examiner*—Kevin Weldon
*Attorney, Agent, or Firm*—Henry W. Cummings

[57] ABSTRACT

In accordance with one embodiment of the present invention, liquid material enters circumferencially into a generally cylindrical outer walled chamber. A baffle may be provided to facilitate circumferencial flow. The tangential, circumferencial flow tends to reduce turbulence. In the outer chamber a top wall is provided and a cushion of air is located between the top wall and the top of the liquid medium to effect cushioning. After circumferencial flow, the liquid flows radially inwardly into an inner fluid chamber through a plurality of openings in an inner cylindrical wall. Within the inner chamber and spaced between the bottom wall and the top wall is a diffuser section. The diffuser section provides a large plurality of parallel fluid flow paths to dampen remaining major currents by lowering the fluid velocity and thus the Reynolds number. The upper surface is arcuate. Thus fluid flows radially upwardly and inwardly to a knife-edged type orifice which results in laminar fluid flow exiting therefrom. In a preferred embodiment, a light source is located within the inner chamber and is offset from the center line of the inner chamber. Focusing means are also provided in the inner chamber to direct the light path so as to align the light path with the orifice so that the light follows the laminar fluid flow.

21 Claims, 5 Drawing Sheets

10
10

159
15
15
150
158
144
142
146

140
144
146
142

156

152
154
135a
139
137
134a
134

13
13
135

FLUID FLOW NOZZLE ASSEMBLY AND METHOD

BACKGROUND OF THE INVENTION

1. Field of the Invention

This invention relates to fluid flow devices, particularly of that class of fluid flow nozzles with laminar discharge, and further to the field of illuminated fluid nozzles.

2. Description of the Prior Art

In U.S. Pat. No. 5,160,086 granted on Nov. 3, 1992, a laminar flow fluid nozzle is provided for use in decorative water fountains, and also for industrial applications. Initial fluid flow is provided through a double-walled, bladder like fluid supply hose (32).

The inflated double hose isolates fluid flow from the pump and other vibrations which would otherwise be transmitted by means of a rigid hose. Furthmore, the double hose functions to absorb or accumulate small pressure variations known as "pump noise" which are usually present in the input stream.

The fluid next flows into a fluid chamber over a baffle (22). Inside pockets of air (18) cushion remaining pressure variations of the fluid stream.

Fluid next flows through a diffuser (20) which provides a purality of parallel fluid baths to dampen remaining major currents by lowering the fluid velocity, and thus the Reynolds number to obtain laminar fluid flow.

A knife edged orifice (12) results in a narrow fluid stream (14). However, orifice (12) may be offset with respect to the center of enclosure (11).

A light transmitting means (24) is aligned with orifice (12) by focusing means (28.

A spring system (30) may be provided to absorb ambiant vibrations.

SUMMARY OF THE INVENTION

Objects of the Invention

1. One object of the present invention is to provide an improved dampening system in the fluid supply hose.
2. Another object of the present invention is to provide an improved pattern of fluid flow within the supply hose.
3. Another object of the present invention is to provide an arrangement for improved fluid flow in the outer fluid chamber.
4. Another object of the present invention is to provide improved fluid flow into the inner fluid chamber.
5. Another object of the present invention is to provide an improved fluid flow pattern from the diffuser means to the orifice.
6. Other objects will be apparent from the following description and drawings.

In accordance with one embodiment of the present invention, liquid material enters circumferencially into a generally cylindrical outer walled chamber. A baffle may be provided to facilitate circumferencial flow. The tangential, circumferencial flow tends to reduce turbulence. In the outer chamber a top wall is provided and a cushion of air is located between the top wall and the top of the liquid medium to effect cushioning. After circumferencial flow, the liquid flows radially inwardly into an inner fluid chamber through a plurality of openings in an inner cylindrical wall. Within the inner chamber and spaced between the bottom wall and the top wall is a diffuser section. The diffuser section provides a large plurality of parallel fluid flow paths to dampen remaining major currents by lowering the fluid velocity and thus the Reynolds number. The upper surface is arcuate. Thus fluid flows radially upwardly and inwardly to a knife-edged type orifice which results in laminar fluid flow exiting therefrom. In a preferred embodiment, a light source is located within the inner chamber and is offset from the center line of the inner chamber. Focusing means are also provided in the inner chamber to direct the light path so as to align the light path with the orifice so that the light follows the laminar fluid flow. In accordance with another embodiment of the present invention the inlet to the outer chamber includes a double walled bladder-like hose wherein fluid is made to flow in a parallel manner first forwardly within the tube and then backwardly within the tube and then again forwardly to further dampen and isolate the system from pressure variations including pump noise.

THE DRAWINGS

DESCRIPTION OF PREFERRED EMBODIMENTS

Figure 2:
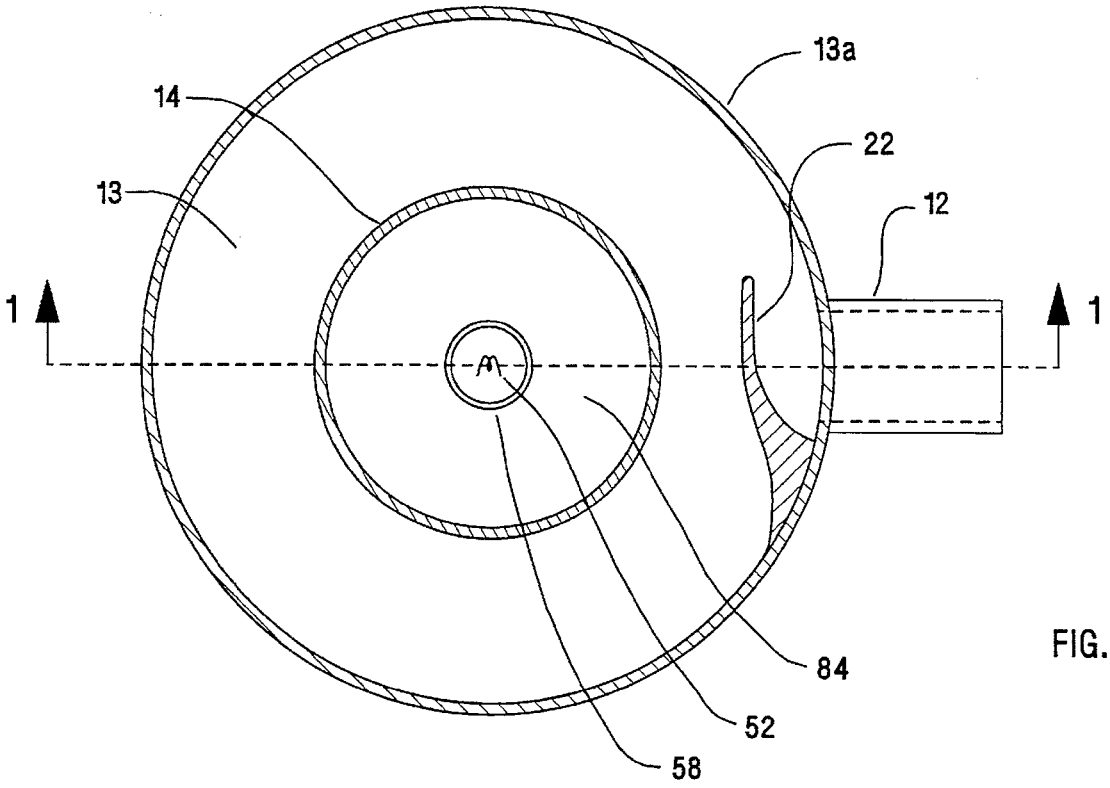
FIG. 2 is a plan view looking in the direction of the arrows along the line 2—2 in FIG. 1.
Figure 1:
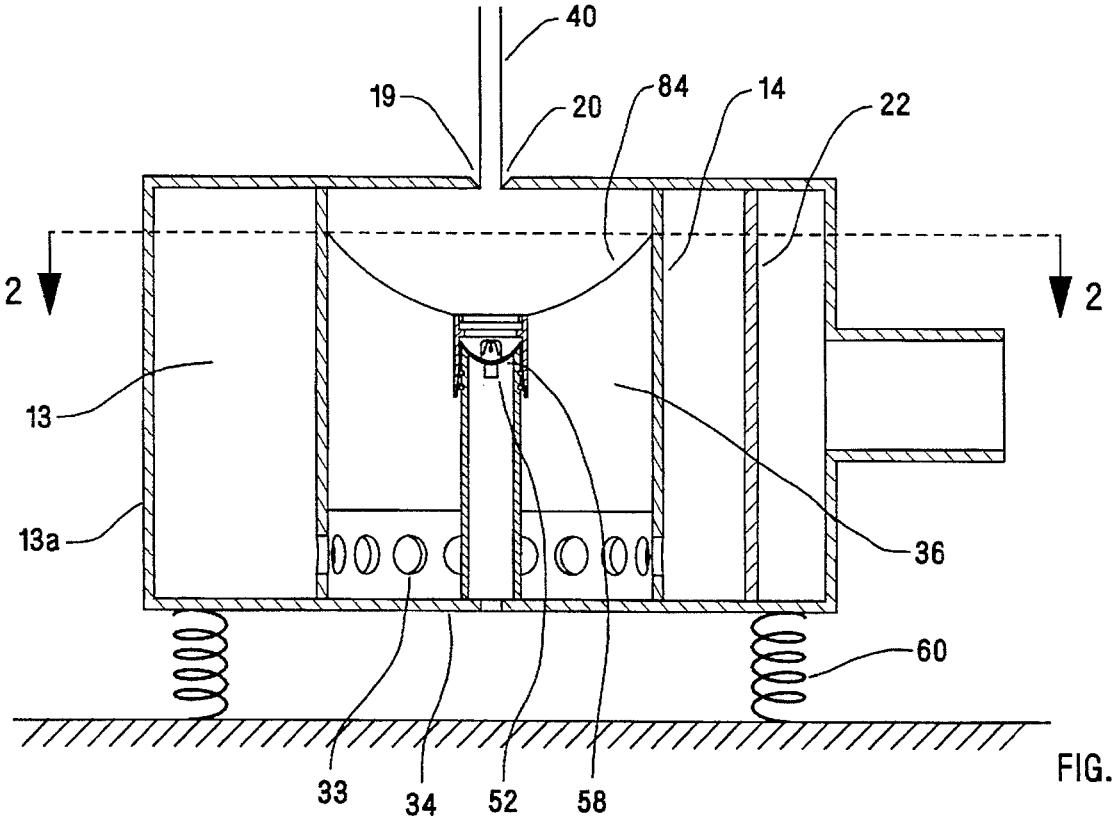
FIG. 1 is is a vertical sectional view of the nozzle assembly of the present invention looking in the direction of the arrows along the line 1—1 in FIG. 2.

Liquid enters through inlet (12) into a generally cylindrical outer chamber (13) including a cylindrical wall (13A).

The outer chamber is defined by the outer cylindrical wall (13A) and an inner cylindrical wall (14), a generally circular top member (18) having an opening for an orifice (19) and a bottom wall (34).

The liquid occupies only a portion of the chamber (13), the upper portion of the chamber is occupied by air as indicated at (24) which provides a cushioning effect on the liquid.

The liquid travels tangentially and circumferentially within the chamber (13) and then flows into an inner chamber (33) through a plurality of openings (30) in the inner cylindrical wall (14).

In the mid portion of the inner chamber (33) is located a diffuser material (36). Diffuser material (36) may be combination of open mesh screens, open cell foam material, a parallel tube assembly or other diffusing means.

The diffuser means provides a very large plurality of parallel fluid paths to dampen all remaining or essentially all remaining major currents by lowering the fluid velocity and thus the Reynolds number.

The top portion (37) of the diffuser is preferably arcuate in shape whereby after the fluid exits from the diffuser the fluid flows radially inwardly toward the opening (19) where the orifice (20) is located. Preferably the orifice (20) is a knife edge orifice.

In one embodiment the opening (19) and orifice (20) are located a distance spaced from the center line of the inner chamber (33). about ⅛th to ¼th of the diameter of the inner chamber.

As the flow exits from the knife-edged orifice (20) fluid flow (40) is essential laminar in character.

Located in the lower portion of the chamber (33) is a light source (52) and a focusing assembly (58). The focusing assembly (58) focuses light eminating from the source (52) such that it is aligned with the orifice (20) and the light flows within the laminar stream (40).

It has been found that the tangential entry and circumferencial flow in chamber (13) is effective to materially reduce turbulence.

At the same time the air in the air chamber (24) provides effective cushioning.

The arcuate top shape of the diffuser is effective to result in more uniform fluid flow from the diffuser into the orifice (20) and thus make a more laminar flow from the orifice (20).

Figure 3:
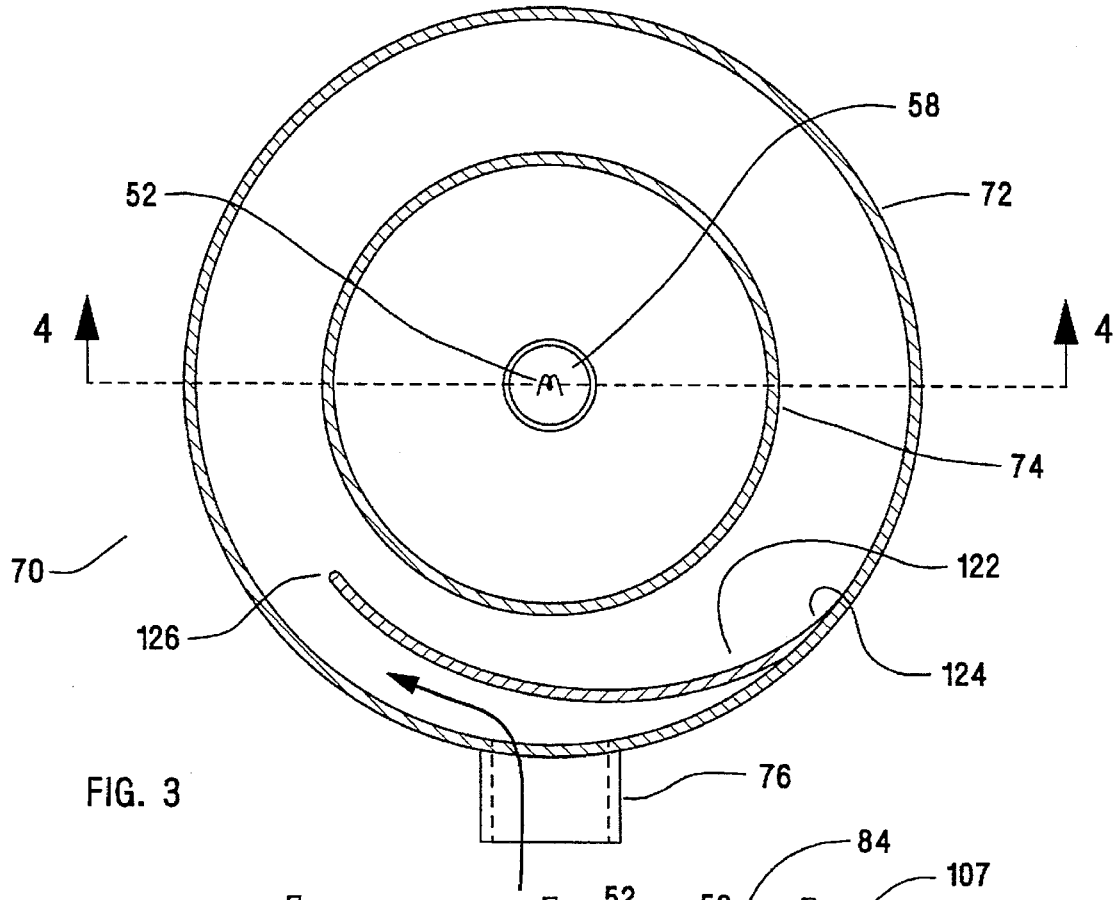
FIG. 3 is a plan view of another embodiment of the present invention.
Figure 4:
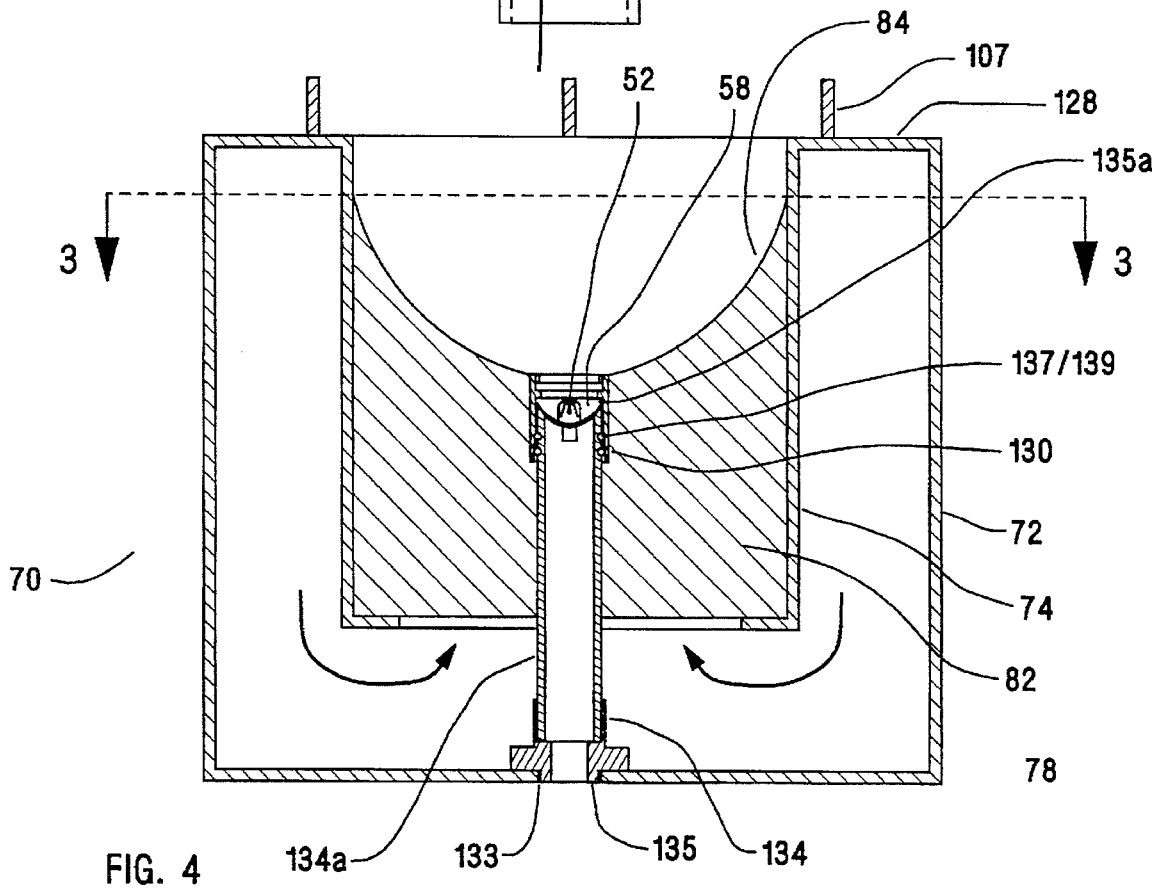
FIG. 4 is a side elevation view of the embodiment shown in FIG. 3 looking in the direction of the arrows along the line 4—4 in FIG. 3.
Figure 8:
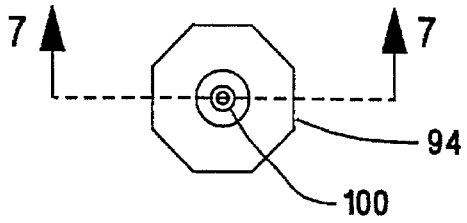
FIG. 8 is a plan view of the orifice assembly illustrated in FIG. 7 looking in direction of the arrows along the line 8—8 in FIG. 7.
Figure 7:
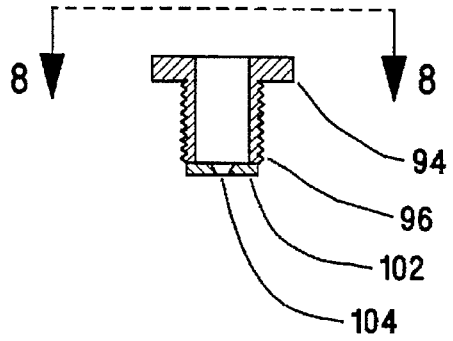
FIG. 7 is a view of the orifice assembly of the present invention.
Figure 9:
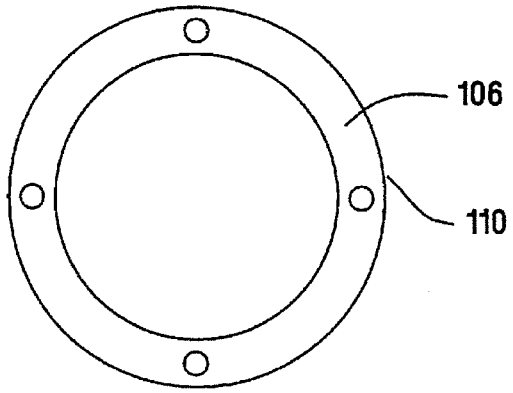
FIG. 9 is a view of a gasket to be utilized in accordance with the present invention.

A spring system (60) comprising one or more springs, for example a generally cylindrical coil spring may also be provided to reduce or dampen ambient vibration, as described in greater detail in U.S. Pat. No. 5,160,086, hereby incorporated into this Description by this reference, Another embodiment of the present invention is illustrated in FIGS. 3 and 4. In this embodiment indicated generally at 70 an outer wall, cylindrical in shape 72, is provided. Located radially inwardly from outer walls 72 is an inner wall 74. Inner wall 74 extends downwardly and is open at the bottom as indicated at 78. A partial top plate 128 and a bottom plate 132 are also provided.

An inlet 76 is connected to the outer wall 72 so that fluid flows inwardly at 76.

An arcuate baffle 122 which is connected to outer wall 72 at 124 is provided. Baffle 122 extends arcuately adjacent to wall 72 and terminates at a point 126, leaving a space for fluid flow 127. Fluid flows downwardly and circumferentially around outer wall 72 into chamber 80 located below opening 78, then tangentially inward and upward through opening 78.

A diffuser 82 similar to diffuser 36 and to diffuser 20 in U.S. Pat. No. 5,160,086 is provided.

However, the upper surface of diffuser 82 is arcuate as indicated at 84.

Figure 5:
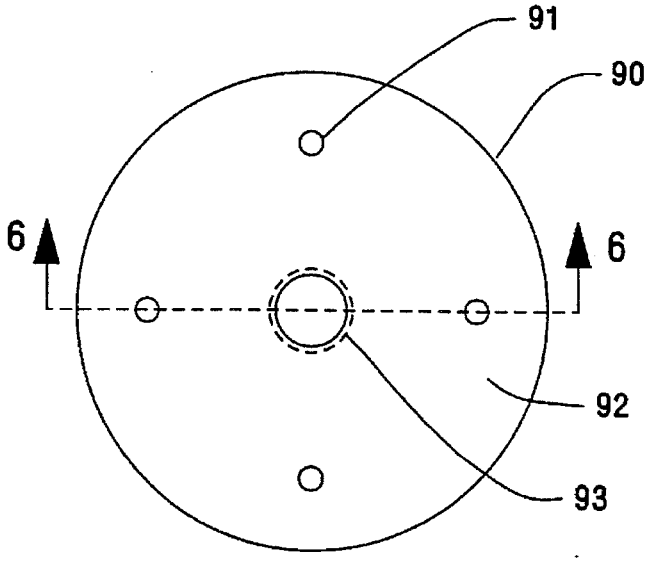
FIG. 5 is a view of a top plate to be used in accordance with the present invention.
Figure 6:
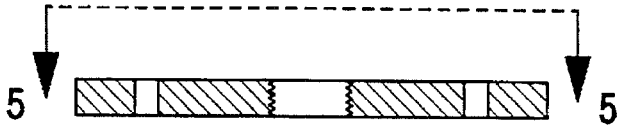
FIG. 6 is a view looking in the direction of the arrows along a line 6—6 in FIG. 5.
Figures 10, 11, 12, 13, 14, 15:
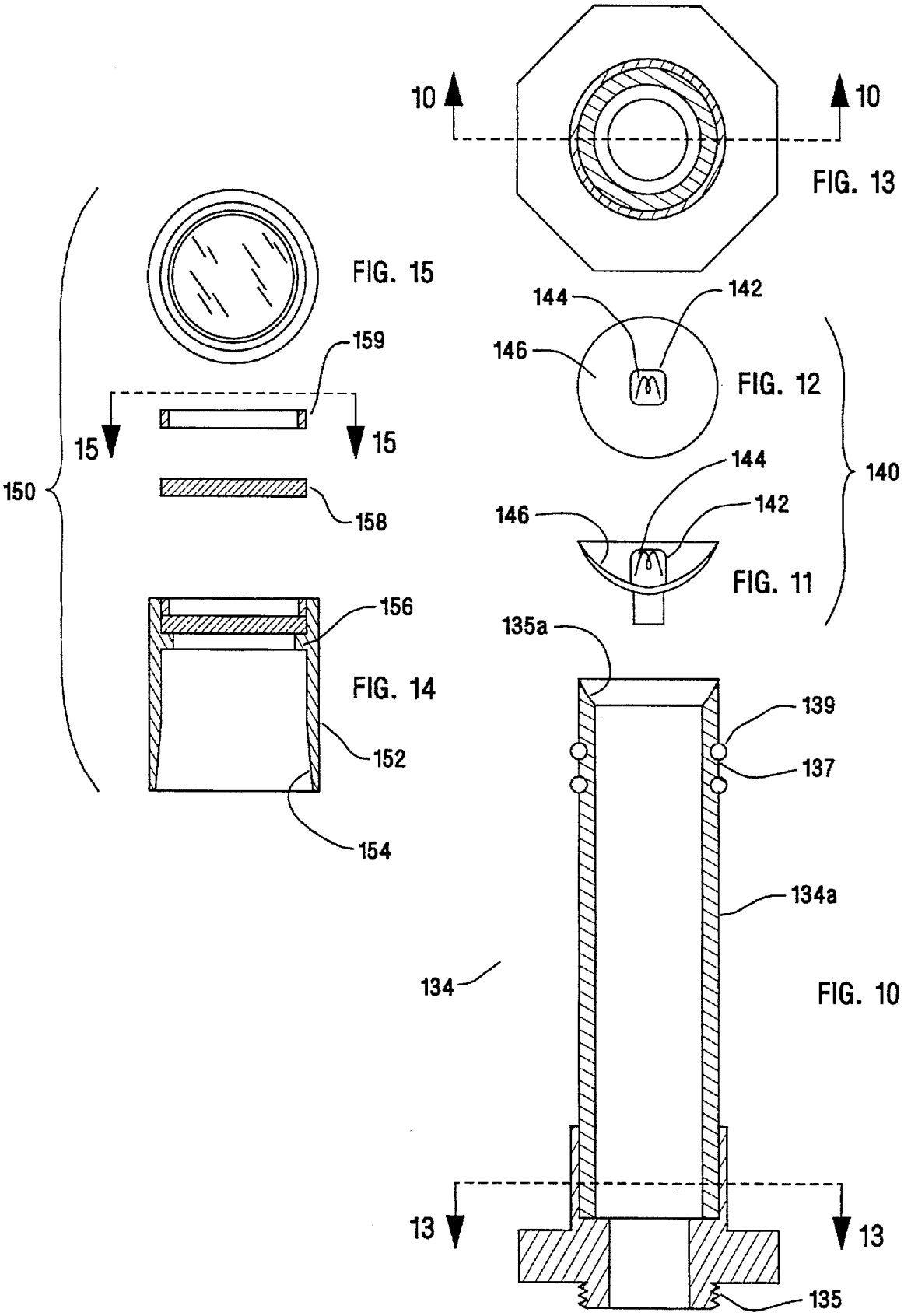
FIG. 10 is a view of a light source and focusing assembly to be utilized in accordance with the present invention.
FIG. 11 is a view illustrating a bulb and focusing assembly to be utilized in the present invention.
FIG. 12 is a plane view of FIG. 11 looking in the direction of the arrows along the line 12—12 in FIG. 11.
FIG. 13 is a plane view of FIG. 11 looking in the direction of the arrows along the line 13—13 in FIG. 12.
FIG. 14 is an exploded view of a lens mounting assembly to be utilized in the present invention.
FIG. 15 is a top view of the lens assembly to utilized in the present invention.

As shown in FIG. 5, a removable cover plate 90 is provided including a body portion 92 and a plurality of spaced openings 108 to align with studs 107 located on partial top plate 128. Body portion 92 has a opening 93 to receive the orifice assembly 94.

The orifice assembly includes a threaded brass member 96 to engage threaded opening 93. Member 96 is hollow, and is connected, for example by silver soldering, to a stainless steel (18-8) washer 102 having a machined or otherwise formed knife edge 104. Laminar fluid flows outwardly through the opening 100.

A gasket 106 having openings 110 is located upon the plate 92. Mechanical fasteners or bolts 112 hold the assembly together.

In the bottom of the assembly a light source and focusing assembly 130 is provided including a bottom plate 132 having an opening 133 to receive a light mounting assembly 134 which is hollow and has a threaded end 135. See FIGS. 4 and 10–15.

Mounting member 134 includes a body portion 134*a* and one or a plurality of O-ring slots 137 to receive O-rings 139.

A light assembly 140 is located within mounting assembly 134 and includes a light housing 142 including a bulb 144 and a focusing light surface 146, A cap assembly 150 includes a hollow cap body portion 152 having a lower tapered portion 154 to facilitate movement over O-rings 139. This assembly includes an inwardly directed projection 156 to receive a lens 158 and a retainer ring 159.

The surface of mounting member 134 is tapered at 135*a* to receive the cooperating tapered surface 146 of light housing 142.

The cap assembly 150 is then applied with the taper 154 facilitating insertion over the O-rings 139.

This assembly 134, 140 and 150 extends upwardly from bottom plate 132 through diffuser 82 and is terminated in the arcuate portion 84 of the diffuser 82.

Fluid thus flows inwardly through inlet 76 and then tangentially through the action of baffle 122 down and around the outer wall 72, tangentially inward under the opening 78 and then upwardly into diffuser 82. Fluid then flows upwardly through diffuser 82 to arcuate surface 84. The fluid flows into orifice assembly 94 and a knife-edged orifice 102 forms laminar flow which exits upwardly and out of the assembly.

Light is generated through bulb 144 and is focused through surface 146 and an appropriate lens 158 is provided for further focussing.

Figure 16:
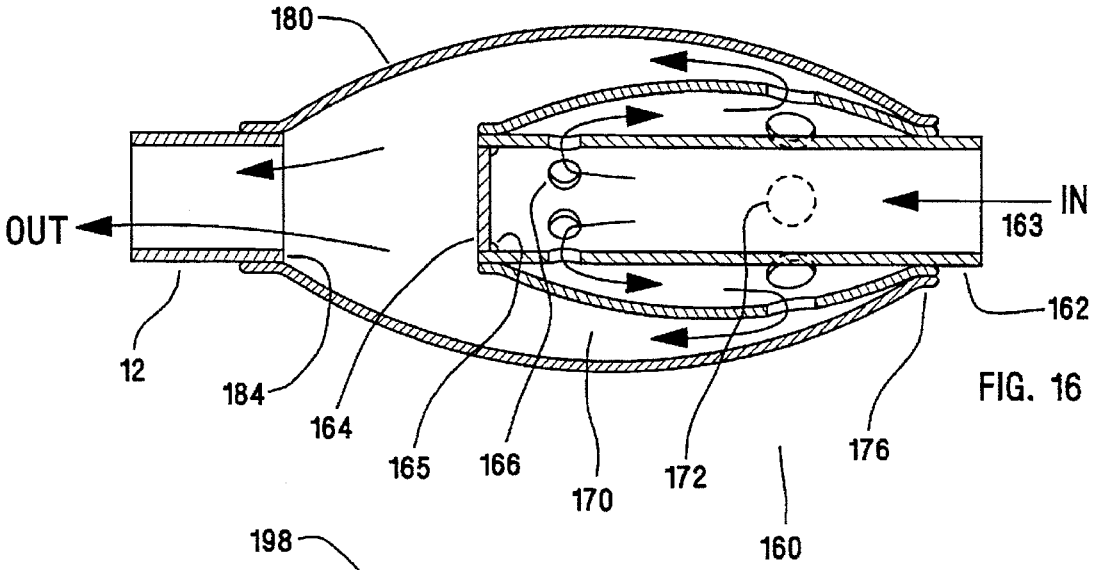
FIG. 16 is a schematic view of one embodiment of the flexible inlet assembly to be utilized in accordance with the present invention.

In accordance with another embodiment of the present invention illustrated in FIG. 16, an improved inlet assembly 160 is provided over that described in U.S. Pat. No. 5,160,086 at 34. The inlet assembly 160 includes an inlet conduit 162 having an opening 163 to receive fluid from a source (not shown). At the inner end of the conduit 162 a block off plate 164 is provided connected to the conducit 162 by welding indicated at 165 or mechanical fasteners.

A plurality of openings 166 are provided about the circumference of conduit 162 through which the fluid flows and into a bladder indicated generally at 170. Bladder 170 is made of flexible impervious material. The fluid flows in an opposite direction to the initial flow through conduit 162 until it reaches openings 172 in bladder 170. The bladder 170 is rigidly connected to the conduit 162 with adhesive as indicated at 176.

Fluid then flows outwardly through the openings 172 and into another flexible conduit or bladder made of impervious material indicated at 180. Fluid then flows again through bladder 180 in the same direction as within conduit 162. The fluid is then transferred to the inlet conduit 12. Conduit 180 is connected to the rigid inlet conduit 12 at 184.

Figure 17:
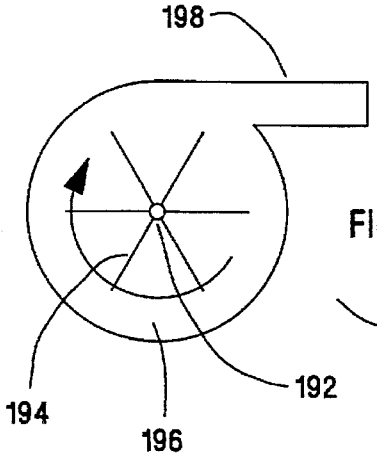
FIG. 17 is a schematic illustration of a cylindrical pump utilized to apply pulses to fluid flowing into a supply pipe.

As indicated in FIG. 17, a centrifical fluid pump 190 includes a shaft 192 having a plurality of outwardly extending veins 194, for example, six, which rotate within a chamber 196 and discharge fluid outwardly through a pipe 198.

Assuming that the shaft 192 rotates 1,720 rpm and with six veins operating, 10,320 pulses are exerted per minute. It is these pulses that it is desirable to eliminate or minimize. The pulses are a part of the fluid flow within the bladder 170. Similar pulses are contained in the conduit 180.

In accordance with the present invention, it has been found that with this parallel, opposite direction flow, these pulses substantially cancel, to reduce or eliminate these pulses in the parallel flow embodiment as illustrated in FIG. 16.

Figure 18:
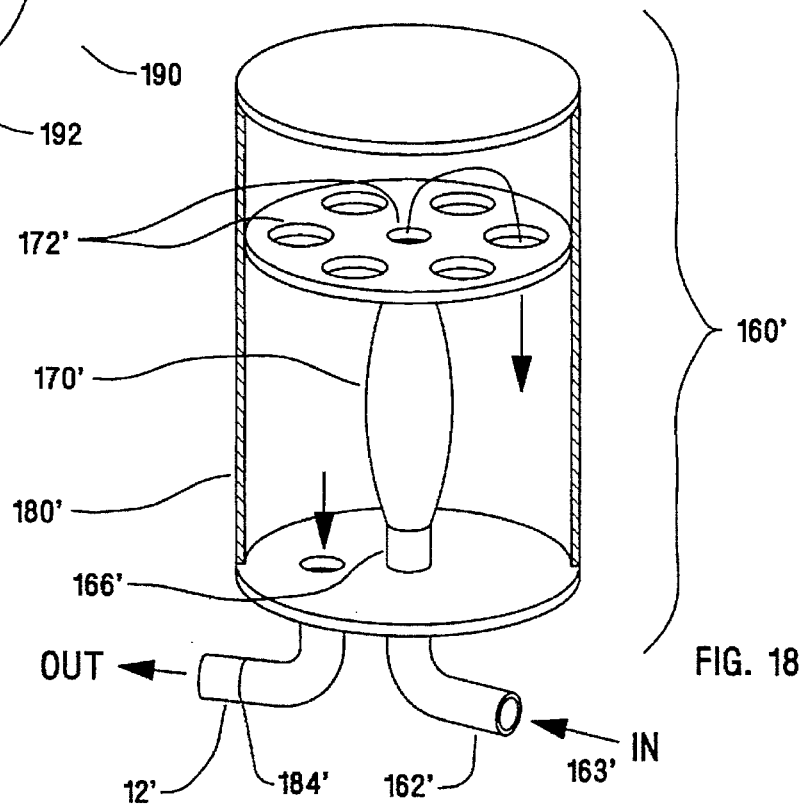
FIG. 18 is a view of another embodiment of the dampening assembly of the present invention.

FIG. 18 is an embodiment similar to FIG. 16 wherein an inlet conduit 162' allows fluid to flow therethrough. The end is blocked off at 164' by a closure plate which is connected by welding or other means at 165'.

Fluid flows outwardly through openings 166' inside a flexible conduit 170' in opposite direction to fluid flow conduit 162' and then outwardly through openings 172' to an outside container 180', which in this embodiment is rigid.

The amount of reduction of pulses is somewhat less in the embodiment shown in FIG. 18, but it is more economical involving less flexible tubing and is more rugged in construction having a rigid outwall 180'.

The most improvement occurs in the embodiment shown in FIG. 16 wherein the other wall 180 is flexible and there is more opportunity for cancellation of pulses as fluid flows within the flexible conduit 170 and the flexible conduit 180.

What is claimed is:

1. An improved laminar flow nozzle comprising:

a generally cylindrical outer wall and a generally cylindrical inner wall radially spaced inwardly from said outer wall;

a generally circular bottom wall and a generally circular top wall defining an outer fluid chamber;

means for introducing liquid into said outer chamber;

means for providing for generally circumferencial flow within said outer chamber;

inlet means located in the lower portion of said inner cylindrical wall to allow fluid flow from said outer chamber into an inner chamber located within said inner cylindrical member and further defined by said bottom wall and said top wall;

diffuser means located within said inner chamber and spaced upwardly from said bottom wall and spaced downwardly from said top wall;

said top wall having an opening therein;

said opening including an orifice means;

whereby fluid enters said outer chamber and flows tangentially and circumferencially in said outer chamber; then flows radially inwardly into said inner chamber through said openings below said diffuser means; then through said diffuser means; whereby major currents are dampened in said diffuses means;

said liquid then flows from said diffuser to said orifice means and said fluid exits from said orifice means with substantially laminar flow.

2. A nozzle assembly according to claim 1 including a light source located within said inner chamber and extending within said diffuser means; and focusing means located in proximity to said light source for focusing light from said light source into alignment with said orifice means.

3. A nozzle assembly according to claim 1 wherein said bottom wall is supported by a dampening resilient means.

4. A nozzle assembly according to claim 1 wherein air is located above said liquid in said outer chamber and said air functions to cushion said liquid.

5. A nozzle assembly according to claim 1 including baffle means located in said outer chamber to direct flow circumferencially in said outer chamber.

6. A nozzle assembly according to claim 1 wherein said diffuser means has an arcuate upper surface to promote uniform flow of fluid from said diffuser means to said orifice means.

7. A nozzle assembly according to claim 6 wherin said orifice means is located in an offset location with respect to the center line of said inner chamber.

8. A nozzle assembly according to claim 7 wherein said orifice means is a knife-edge type orifice.

9. An improved method for obtaining a laminar stream of fluid flow comprising:

providing a generally cylindrical outer wall and a generally cylindrical inner wall defining a generally cylindrical outer chamber;

introducing liquid into said outer chamber tangentially;

directing fluid flow within said chamber circumferencially;

providing an inner chamber defined by said generally cylindrical inner wall located within said outer chamber;

forming openings in the lower portion of said inner cylindrical wall;

causing fluid to flow radially inwardly through said openings from said outer chamber into said inner chamber;

locating within said inner chamber a diffuser .means including a plurality of parallel fluid flow paths and having an arcuate upper surface;

causing fluid to flow through said diffuser means to dampen major currents of fluid velocity;

causing fluid to flow radially inwardly from said arcuate surface to an orifice located above said diffuser means in said inner chamber;

forming a laminar stream by said orifice; and guiding laminar fluid flow from said assembly.

10. A method according to claim 9 including cushioning of said liquid in said outer chamber with air.

11. A method according to claim 9 including locating a light source within said inner chamber and focusing said light source to align with said orifice to pass into said laminar fluid flow.

12. An improved laminar flow nozzle comprising:

a generally cylindrical outer wall and a generally cylindrical inner wall radially spaced inwardly from said outer wall said inner wall having a lower portion;

a generally circular bottom wall and a generally circular top wall defining an outer fluid chamber;

means for introducing liquid into said outer chamber;

means for providing for generally circumferencial flow within said outer chamber;

said lower portion of said inner cylindrical wall spaced from said bottom wall to allow fluid flow from said outer chamber into an inner chamber located within or below said inner cylindrical member, said inner chamber further defined by said bottom wall and said top wall;

diffuser means located within said inner chamber and spaced upwardly from said bottom wall and spaced downwardly from said top wall;

said top wall having an opening therein;

said opening including an orifice means whereby fluid enters said outer chamber and flows tangentially and circumferencially in said outer chamber; then flows downwardly into said inner chamber in said inner wall below said diffuser means; then through said diffuser means; whereby major currents are dampened in said diffuses means; said liquid then flows from said diffuser to said orifice means and said fluid exits from said orifice means with substantially laminar flow.

13. A nozzle assembly according to claim 12 including a light source located within said inner chamber and extending within said diffuser means; and focusing means located in proximity to said light source for focusing light from said light source into alignment with orifice means.

14. A nozzle assembly according to claim 12 wherein said bottom wall is supported by a dampening resilient means.

15. A nozzle assembly according to claim 12 wherein air is located above said liquid in said outer chamber and said air functions to cushion said liquid.

16. A nozzle assembly according to claim 12 including baffle means located in said outer chamber to direct flow circumferencially in said outer chamber.

17. A nozzle assembly according to claim 16 wherin said baffle means is arcuate in shape and is attached at one end to said outer wall to direct flow circumferencially in said outer chamber.

18. A nozzle assembly according to claim 12 wherein said diffuser means has an arcuate upper surface to promote uniform flow of fluid from said diffuser means to said orifice means.

19. A nozzle assembly according to claim 18 wherein said orifice means is located in an offset location with respect to the center line of said inner chamber.

20. A nozzle assembly according to claim 12 wherein said orifice means is a knife-edge type orifice.

21. An improved method for obtaining a laminar stream of fluid flow comprising:

providing a generally cylindrical outer wall and a generally cylindrical inner wall defining a generally cylindrical outer chamber;

introducing liquid into said outer chamber tangentially;

directing fluid flow within said chamber circumferencially;

providing an inner chamber defined by said generally cylindrical inner wall located within or below said outer chamber;

forming an opening in the lower portion of said inner cylindrical wall;

causing fluid to flow downwardly through said opening from said outer chamber into said inner chamber;

locating within said inner chamber a diffuser means including a plurality of parallel fluid flow paths said inner wall having a lower portion;

causing fluid to flow through said diffuser means to dampen major currents of fluid velocity;

causing fluid to flow radially inwardly from said arcuate surface to an orifice located above said dampening medium in said inner chamber;

forming a laminar stream by said orifice; and guiding laminar fluid flow from said assembly.

* * * * *